United States Patent [19]

Sekiya et al.

[11] Patent Number: 4,703,726

[45] Date of Patent: Nov. 3, 1987

[54] LUBRICATING SYSTEM FOR ENGINE

[75] Inventors: Yoshiyuki Sekiya; Sakae Mizumura, both of Tokyo; Teruo Kihara, Saitama, all of Japan

[73] Assignee: Honda Giken Kogyo Kabushiki Kaisha, Tokyo, Japan

[21] Appl. No.: 893,797

[22] Filed: Aug. 6, 1986

[30] Foreign Application Priority Data

Aug. 8, 1985 [JP] Japan ..... 60-174619

[51] Int. Cl.[4] ..... F01M 1/00

[52] U.S. Cl. ..... 123/196 AB; 123/198 C; 184/104.2

[58] Field of Search ..... 123/196 AB, 196 R; 184/104.2, 104.3

[56] References Cited

U.S. PATENT DOCUMENTS 3,486,582 12/1969 Carter et al. ..... 123/196 R
4,449,487 5/1984 Krüger et al. ..... 123/196 AB

FOREIGN PATENT DOCUMENTS 2656223 6/1978 Fed. Rep. of Germany ... 123/196 R
56-24250 6/1981 Japan .
56-42403 10/1981 Japan .
1491342 11/1977 United Kingdom ..... 184/104.2

*Primary Examiner*—E. Rollins Cross
*Attorney, Agent, or Firm*—Lyon & Lyon

[57] ABSTRACT

A lubricating system for an engine comprises an oil pan for storing a lubricating oil therein, an oil cooler for cooling the lubricating oil, and an oil pump including first and second pump rotors contained in a casing. The oil pump is provided with a suction port commonly used for both the pump rotors, a first discharge port exclusively used for the first pump rotor and a second discharge port exclusively used for the second pump rotor. The suction port is in communication with the subsurface of the oil in the oil pan, the first discharge port communicating with an inlet port of the oil cooler, and said second discharge port communicating with the to-be-lubricated portions of an engine. A second suction port is provided in the casing of said oil pump to be exclusively used for the second pump rotor, and an outlet port of said oil cooler is connected with the second suction port, so that the entire amount of the lubricating oil passed through the oil cooler is supplied to the to-be-lubricated portions under the action of the second pump rotor.

5 Claims, 2 Drawing Figures

LUBRICATING SYSTEM FOR ENGINE

BACKGROUND OF THE INVENTION

1. Field of the Invention

The present invention relates to a lubricating system for an engine, which comprises an oil pan for storing a lubricating oil therein, an oil cooler for cooling the lubricating oil, and an oil pump including first and second pump rotors contained in a casing. The oil pump is provided with a suction port commonly used for both the pump rotors, a first discharge port exclusively used for the first pump rotor and a second discharge port exclusively used for the second pump rotor. The suction port is in communication with the subsurface of the oil in the oil pan, the first discharge port being with an inlet port of the oil cooler, and the second discharge port being with the to-be-lubricated portions of an engine.

2. Description of the Prior Art

In FIG. 2 there is shown such a conventional lubricating system, wherein a lubricating oil cooled by an oil cooler 2 and a lubricating oil returned from a to-be-lubricated portion 3 of an engine are stored in an oil pan 1. An oil pump 4 comprises a first pump rotor serving for sucking the lubricating oil within the oil pan 1 into the pump through a common suction port 4*a* to pump it into a first discharge port 4*e* connected to an inlet port of the oil cooler, and a second pump rotor 4*c* serving for sucking the lubricating oil within the oil pan 1 into the pump through the common suction port 4*a* to supply it to the to-be-lubricated portion of the engine. An outlet port of the oil cooler is in communication with the oil pan.

The entire amount of the lubricating oil cooled in the oil cooler 2 is returned directly to the oil pan 1 to cool the lubricating oil stored in the oil pan 1, while the lubricating oil supplied from the oil pan to the to-be-lubricated portion 3 of the engine under the action of the second pump rotor 4*c* is returned to the oil pan 1 after lubrication. When the lubricating oil cooled in the oil cooler 2 has been returned directly to the oil pan in this manner, the temperature thereof is increased by the lubricating oil already stored in the oil pan 1. This causes the lubricating oil which has been satisfactorily not cooled to be resupplied to the to-be-lubricated portion, resulting in a failure to satisfactorily make efficient use of the function of the oil cooler.

In addition, because the lubricating oil is pressurized by the first pump rotor 4*b*, it enters the oil pan 1 with a substantial force. This causes the lubricating oil within the oil pan 1 to be vigorously stirred to produce bubbles in the oil. Before the bubbles disappear, the lubricating oil is pumped through the suction port 4*a* again to the oil cooler 2 and the to-be-lubricated portion 3 by the oil pump 4. If the lubricating oil with the bubbles entrained therein is supplied to the to-be-lubricated portion 3 of the engine, a failure in lubrication may be caused, resulting in a hindrance to the durability of the engine.

SUMMARY OF THE INVENTION

It is therefore an object of the present invention to provide a lubricating system for an engine, wherein a lubricating oil cooled in an oil cooler can be reliably supplied to portions which are to be lubricated, and bubbles may be less produced in the lubricating oil, lending to no possibility of a failure in lubrication.

To accomplish the above object, according to the present invention, there is provided a lubricating system for an engine, comprising an oil pan for storing a lubricating oil therein, an oil cooler for cooling the lubricating oil, and an oil pump including first and second pump rotors contained in a casing, the oil pump being provided with a suction port commonly used for both the pump rotors, a first discharge port exclusively used for the first pump rotor and a second discharge port exclusively used for the second pump rotor, the suction port being in communication with a subsurface of the oil in the oil pan, the first discharge port communicated with an inlet port of the oil cooler, and the second discharge port communicated with to-be-lubricated portions of an engine, wherein a second suction port exclusively used for the second pump rotor is provided in the casing of the oil pump, and an outlet port of the oil cooler is connected with the second suction port.

With such arrangement, the entire amount of the lubricating oil cooled in the oil cooler is passed into the second suction port of the oil pump and then pumped into the second discharge port under the pumping action of the second pump rotor, thus enabling the cooled lubricating oil to be reliably supplied to the to-be-lubricated portions of the engine.

In this case, the second pump rotor allows the lubricating oil within the oil pan to be also sucked into the oil pump through the common suction port and to be pumped into the second discharge port and therefore, the lubricating oil can be supplied in a sufficient amount to the to-be-lubricated portions.

Moreover, because the lubricating oil within the oil pan cannot be stirred by the lubricating oil passed through the oil cooler, the generation of bubbles is extremely reduced and thus, the lubricating oil with an extremely small amount of bubbles entrained therein can be supplied to the to-be-lubricated portions.

The above and other objects, features and advantages of the invention will become apparent from reading of the following description taken in conjunction with the accompanying drawings.

DESCRIPTION OF THE PREFERRED EMBODIMENTS

Figure 1:
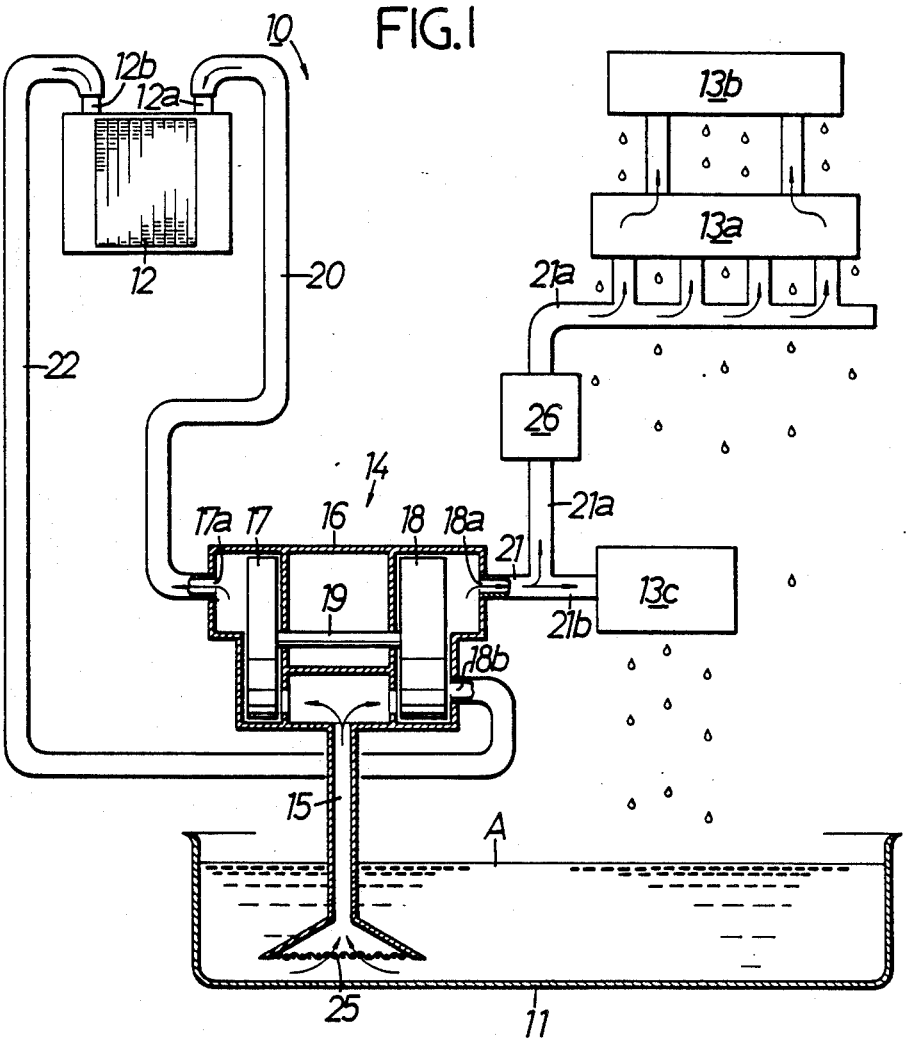
FIG. 1 is a schematic view in vertical section of the details of a lubricating system for an engine according to the present invention.
Figure 2:
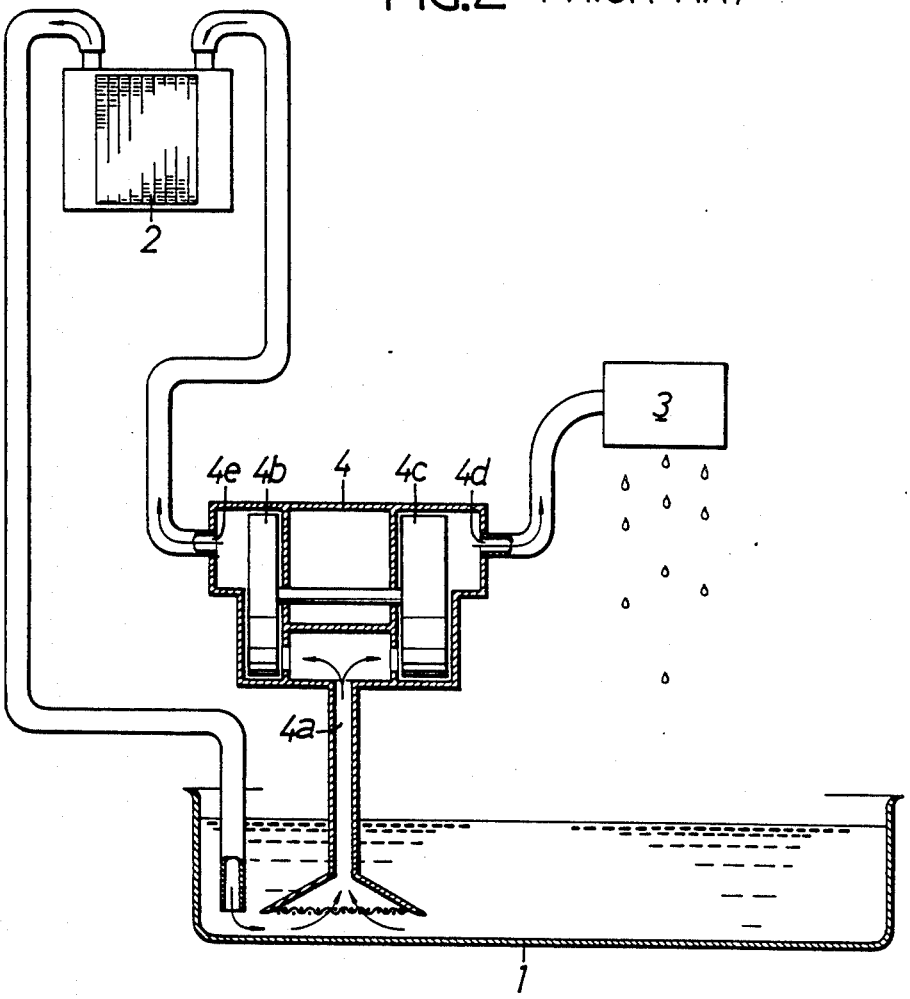
FIG.2 PRIOR ART
FIG. 2 is a schematic view in vertical section of the details of a conventional lubricating system.

The present invention will now be described by way of one embodiment with reference to FIG. 1. In an engine for a motorcycle, a to-be-lubricated portion 13*a* around a crank shaft, a to-be-lubricated portion 13*b* of a valve operating mechanism and a to-be-lubricated portion 13*c* of a transmission are lubricated by a lubricating system 10 according to the present invention.

The lubricating system 10 essentially comprises an oil pan 11 for storing a lubricating oil A, an oil cooler 12, and an oil pump 14 for pumping the lubricating oil A to the oil cooler 12 and the to-be-lubricated portions 13*a* to 13*c*.

The oil pump 14 includes a stational casing 16, and first and second pump rotors 17 and 18 contained within the casing 16. The pump rotors 17 and 18 are secured to the opposite ends of a common pump shaft 19 driven from the crank shaft of an engine which is not shown, and are adapted to be always rotated during operation of the engine. The second pump rotor 18 is constituted in a volume larger than that of the first pump rotor 17. Provided in the casing 16 are a first suction port 15 commonly used for both the pump rotors 17 and 18, a second suction port 18b exclusively used for the second pump rotor 18, a first discharge port 17a exclusively used for the first pump rotor 17, and a second discharge port **18*a* exclusively used for the second pump rotor 18. The first suction port 15 is in communication with the subsurface of the oil within the oil pan 11 through a strainer 25, and the first discharge port 17*a* is connected through an oil passage 20 to an inlet port 12*a* of the oil cooler 12, while the second suction port 18*b* is connected through an oil passage 22 to an outlet port 12*b* of the oil cooler 12**.

An oil passage 21 is connected to the second discharge port **18*a* and diverged at the downstream portion into two passages: a first lubricating oil passage 21*a* and a second lubricating oil passage 21*b*. The first lubricating oil passage 21*a* has an oil filter 26 incorporated on the way thereof. Downstream of the oil filter 26, there are the to-be-lubricated portion 13*a* around the crank shaft and the to-be-lubricated portion 13*b*** of a valve operating mechanism.

On the other hand, the to-be-lubricated portion **13*c* of a transmission is connected to the second lubricating oil passage 21*b***.

In operation of this embodiment, when the first and second pump rotors 17 and 18 of the oil pump 14 are rotated with the operation of the engine, the lubricating oil A stored in the oil pan 11 is sucked into the first suction port 15 while being filtered by the strainer 25, and the lubricating oil entering the casing 16 is diverted in two directions toward the first and second pump rotors 17 and 18. Then, the lubricating oil directed toward the first pump rotor 17 is pumped through the first discharge port **17*a* to the oil cooler 12 and is cooled during passing therethrough, and the entire maount of the lubricating oil passed through the cooler 12 is passed into the second suction port 18*b* exclusively used for the second pump rotor 18**.

Since the second pump rotor 18 is constituted in a volume larger than that of the first pump rotor 17, the lubricating oil flow diverted from the first suction port 15 toward the second pump rotor 18 is joined with the flow of the lower temperature lubricating oil which has entered the second suction port **18*b* and then, the resultant lubricating oil is pumped through the second discharge port 18*a* into the first and second lubricating oil passages 21*a* and 21*b*. The lubricating oil passed into the first lubricating oil passage 21*a* is filtered in the oil filter 26 and then supplied to the to-be-lubricated portion 13*a* around the crank shaft and the to-be-lubricated portion 13*b* of the valve operating mechansim to successively cool them while lubricating them. On the other hand, the lubricating oil passed into the second lubricating oil passage 21*b* is supplied to the to-be-lubricated portion 13*c* of the transmission to cool it while lubricating it. The lubricating oil which has lubricated the to-be-lubricated portions 13*a*, 13*b* and 13*c* is returned to the oil pan 11**.

In this way, the entire amount of the lubricating oil cooled in the oil cooler 12 is provided for the lubrication of the first to third to-be-lubricated portions **13*a* to 13*c* and therefore, not only the lubrication of them but also the cooling of them can be reliably carried out. Moreover, since the lubricating oil A stored in the oil pan 11** cannot be stirred by the lubricating oil from the oil cooler, less bubble is produced in the oil, thus making it possible to ensure a constantly good lubrication.

What is claimed is:

1. A lubricating system for an engine, comprising an oil pan for storing a lubricating oil therein, an oil cooler for cooling the lubricating oil, and an oil·pump including first and second pump rotors contained in a casing, said oil pump being provided with a suction port commonly used for both the pump rotors, a first discharge port exclusively used for the first pump rotor and a second discharge port exclusively used for the second pump rotor, said suction port being in communication with a subsurface of the oil in the oil pan, said first discharge port communicating with an inlet port of the oil cooler, and said second discharge port communicating with to-be-lubricated portions of an engine, wherein a second suction port exclusively used for the second pump rotor is provided in the casing of said oil pump, and an outlet port of said oil cooler is connected with the second suction port.

2. A lubricating system for an engine according to claim 1, wherein said second pump rotor is constituted in volume larger than said first pump rotor.

3. A lubricating system for an engine according to claim 1, wherein an oil filter is incorporated in an oil passage connecting said second discharge port with the to-be-lubricated portions.

4. A lubricating system for an engine according to claim 3, wherein said to-be-lubricated portions are a to-be-lubricated portion around a crank shaft of an engine and a to-be-lubricated portion of a valve operating mechanism.

5. A lubricating system for an engine according to claim 1, wherein an oil passage connected to said second discharge port is branched into first and second lubricating oil passages, the to-be-lubricated portion around the crank shaft of the engine and the to-be-lubricated portion of the valve operating mechanism being in communication with said first lubricating oil passage, and the to-be-lubricated portion of a transmission being in communication with the second lubricating oil passage.

* * * * *